US009106002B2

(12) United States Patent
Mayer et al.

(10) Patent No.: US 9,106,002 B2
(45) Date of Patent: Aug. 11, 2015

(54) METHOD FOR SEALING AN ELECTRICAL COUPLING PIECE, AND COUPLING PIECE

(71) Applicant: NEXANS, Paris (FR)

(72) Inventors: Udo Mayer, Weiden (DE); Helmut Steinberg, Stoernstein (DE); Thomas Noetzel, Floss (DE)

(73) Assignee: NEXANS, Paris (FR)

( * ) Notice: Subject to any disclaimer, the term of this patent is extended or adjusted under 35 U.S.C. 154(b) by 47 days.

(21) Appl. No.: 14/021,072

(22) Filed: Sep. 9, 2013

(65) Prior Publication Data

US 2014/0073162 A1 Mar. 13, 2014

(30) Foreign Application Priority Data

Sep. 10, 2012 (EP) ..... 12306084

(51) Int. Cl.
*H01R 13/52* (2006.01)
*H01R 43/24* (2006.01)
*H01R 13/504* (2006.01)

(52) U.S. Cl.
CPC ..... *H01R 13/5205* (2013.01); *H01R 13/5202* (2013.01); *H01R 43/24* (2013.01); *H01R 13/504* (2013.01)

(58) Field of Classification Search
CPC ..... H01R 13/5205
USPC ..... 439/604, 606, 676
See application file for complete search history.

(56) References Cited

U.S. PATENT DOCUMENTS

| | | | | |
|---|---|---|---|---|
| 5,126,619 | A * | 6/1992 | Wakimizu et al. | 313/25 |
| 5,941,718 | A * | 8/1999 | Didier | 439/170 |
| 5,984,724 | A * | 11/1999 | McNeel | 439/606 |
| 6,435,911 | B1 * | 8/2002 | Payson et al. | 439/606 |
| 6,482,036 | B1 * | 11/2002 | Broussard | 439/606 |
| 8,550,846 | B2 * | 10/2013 | Nachbauer et al. | 439/606 |
| 8,740,655 | B2 * | 6/2014 | Kato et al. | 439/736 |
| 2012/0184128 | A1 * | 7/2012 | Nachbauer et al. | 439/460 |
| 2013/0000946 | A1 * | 1/2013 | Nachbauer et al. | 174/110 SR |

FOREIGN PATENT DOCUMENTS

DE 7340330 2/1974

* cited by examiner

*Primary Examiner* — James Harvey
(74) *Attorney, Agent, or Firm* — Sofer & Haroun, LLP

(57) ABSTRACT

A method for sealing an electric coupling piece (K) against moisture, includes, at an end of the line (1) intended for connection to the coupling piece (K), at least one annular groove extending in the circumferential direction is cut into the casing of the line (1). Prior to injection molding the protective body (9), an O-ring (10) serving as a sealing element is placed into the groove, where the O-ring (10) rests tightly against the lateral borders of the groove (11) with the respective pretension, where the O-ring is of a material which connects tightly and in a moisture proof manner to the insulating material of the finely produced protective body (9).

2 Claims, 1 Drawing Sheet

METHOD FOR SEALING AN ELECTRICAL COUPLING PIECE, AND COUPLING PIECE

RELATED APPLICATION

This application claims the benefit of priority from European Patent Application. No. 12 306 084.0, filed on Sep. 10, 2012, the entirety of which is incorporated by reference.

BACKGROUND

1. Field of the Invention

The invention relates to a method for sealing an electrical coupling piece against moisture, in which electrical conductors of a line, which includes a casing of insulating material which jointly surrounds the conductors, are connected to electrical contact elements of the coupling piece, in which a ring-shaped sealing element is mounted on the casing of the line, and in which a protective body of insulating material is injection molded at the connecting point between conductors and contact elements and around the line so as to enclose the sealing element; the invention further relates to a coupling piece.

Such a method and such a coupling piece are disclosed in FP 2 485 336 A1.

2. Description of Related Art

A coupling piece in the sense of the invention may be a socket or a plug equipped with electrical sleeve contacts or with electrical plug pins. In accordance with conventional technology, such a coupling piece is mounted at the end of an electrical line for producing a so-called ready-made line which has aria chosen number of strands consisting of insulated electrical conductors which are surrounded by a common casing of insulating material. For manufacturing a coupling piece, the strands are freed from the casing over a predetermined length at the end of the line. The insulation is subsequently removed from the strands at their free ends and the exposed conductors are electrically conductively connected to the contact elements of the coupling piece. Finally, a protective body consisting of insulating material is injection molded in an injection molding tool around the connecting point between conductors and conducting elements as well as around the line. A moisture tight cover of the connecting point is achieved when the protective body is sufficiently tightly connected to the casing of the line. A corresponding connection can be achieved in conventional lines by a suitable selection of the materials of the protective body and of the casing of the line. However, in lines which are used in areas with high temperatures and in which the material of the casing is cross linked, there are problems with respect to sealing against moisture.

DE 73 40 330 U discloses a device for reducing the tension in contact points of an electrical plug which is injection molded onto an electrical line insulated with rubber. A tightly fitted plastic ring is arranged on the line, wherein the bore of the ring is smaller than the diameter of the line, at least at one location. The plastic ring is enclosed by the body of the plug.

In the method according to the above mentioned EP 2 485 336 A1, prior to injection molding the protective body, a sealing ring surrounded by two parts of a capsule is applied to the casing of the line which, in the same manner as the parts of the capsule, rest against the surface of the casing and is simultaneously injection molded onto the casing. The parts of the capsule are connected to the protective body in a moisture tight manner. This method has been found useful in practice. However, because the surface of the casing of the line is frequently not completely round, but rather is somewhat undulated, the circumferential gap between the sealing ring and the parts of the capsule, on the one hand, and the casing on the other hand, is not completely sealed off in unfavorable cases.

OBJECTS AND SUMMARY

The invention is based on the object of configuring the method described in the beginning in such a way that a moisture tight construction of the coupling piece is ensured under all possible conditions while being of simple construction.

In accordance with the invention, this object is met in that, at an end of the line designated for connection to the coupling piece, at least one annular groove, extending in the circumferential direction, is cut into the casing of the line, and that, prior to injection molding of the protective body, an O-ring serving as sealing element is placed in the groove which rests with corresponding pretension tightly against the lateral borders of the groove, and which consists of a material which connects tightly and in a moisture tight manner to the insulating material of the finally produced protective body.

This method can be carried out especially simply because, in addition to the work steps required for the manufacture of the electrically conductive connection between the conductors of the line and the contact elements of the coupling piece, only at least one groove extending in the circumferential direction of the line has to be cut into the casing of the line, for example, by means of a milling cutter. Prior to injection molding the protective body, a commercially available O-ring is placed in the groove, wherein the O-ring is slid onto the line in an expanded state and rests with appropriate tension tightly against the lateral borders of the groove. Consequently, the groove is hermetically sealed by the O-ring, providing the advantage that any possible non-round areas in the surface of the casing of the line cannot negatively affect the sealing action to be obtained. The material of the finely injection molded protective body which is adapted to the material of the O-ring connects securely and in a moisture tight manner to the O-ring. Consequently, the area between the protective body and the casing of the line is circumferentially hermetically tightly sealed. As a result, no moisture can penetrate along the line up to the connecting point between the conductors of the line and the contact element of the coupling piece.

BRIEF DESCRIPTION OF THE DRAWINGS

An embodiment of the method according to the invention will be explained in the following with the aid of the drawings.

In the drawing.

DETAILED DESCRIPTION

Figure 1:
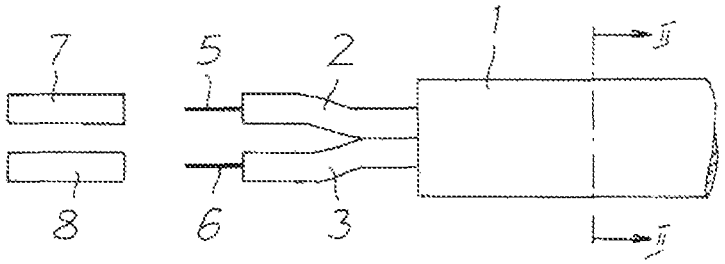
FIG. 1 is a schematic illustration of an electrical line from which the casing has been removed, with two strands and two contact elements separated from the strands.
Figure 2:
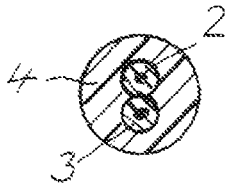
FIG. 2 is a sectional view through FIG. 1 taken along sectional line II-II.

FIG. 1 shows the end of an electrical line 1 which includes two electrical strands 2 and 3 surrounded by a common casing 4 (FIG. 2) of insulating material. The strands 2 and 3 each have an electrical conductor 5 or 6 respectively, surrounded by an insulation. They are preferably roped together in the line 1. The line 1 can also have more than 2 strands which are surrounded by a common casing of insulating material.

FIG. 1 also shows two electrical contact elements 7 and 8 by means of which the conductors 5 and 6 of the line 1 are to be electrically conductively connected. The contact elements 7 and 8 may be sleeve contacts or plug contacts. They are, for example, of copper or a copper alloy.

Figure 3:
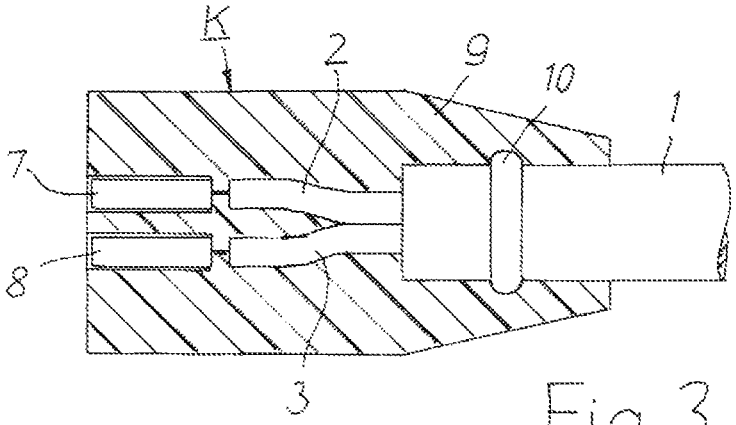
FIG. 3 shows a schematic sectional view of a coupling piece manufactured by the method according to the invention.

FIG. 3 shows a sectional view through a coupling piece K which is mounted at the end of the line 1. The conductors 5 and 6 of the strands 2 and 3 are electrically conductively connected to the contact elements 7 and 8, for example, by crimping. The connecting point between the conductors 5 and 6 and the contact elements 7 and 8 is surrounded by a protective body 9, composed of insulating material and manufactured by injection molding, which extends beyond the line 1. The protective body 9 also surrounds the contact elements 7 and 8 over their entire axial length, however, while leaving blank the end faces, which face away from the line 1, so that sufficient space is available for pushing on counter contacts or for pushing in counter contacts. The protective body 9 is composed preferably of polyamide or of a thermoplastic polyurethane (TPU) or of polybutylene terephthalate (PBT).

Figure 4:
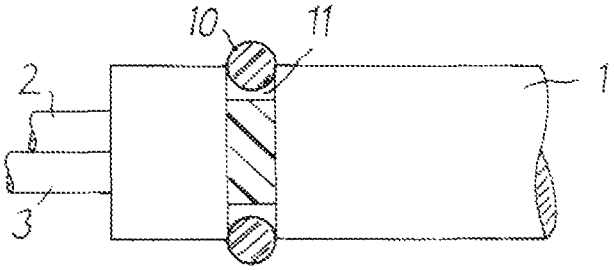
FIG. 4 shows a detail from FIG. 3 on a larger scale.

Also surrounded by the protective body 9 is a sealing element constructed as an O-ring 10 which is arranged on the casing 4 of the line 1, specifically in a groove 11 extending in circumferential direction of the line 1, as shown in FIG. 4. The O-ring 10 preferably consists of a polyurethane material such as for example, a thermoplastic polyurethane or polyurethane per se. The groove 11 and the O-ring 10 are dimensioned in such a way that, in the assembly position shown in FIG. 4, the O-ring is tightly and securely resting against the two lateral borders of the groove 11. However, it is also possible to arrange two or more grooves in the casing 4 of the line 1, which extend in the circumferential direction of the line 1 and parallel to each other, in which an O-ring each is arranged in the assembled position. All O-rings are covered, if applicable, in the finished coupling piece K by the protective body 9.

The method according to the invention is carried out, for example, as follows:

The casing 4 of the line 1 is removed at the end of the line over a predetermined length, so that the strands 2 and 3 are exposed. The insulation is then removed at the ends of the strands 2 and 3, so that the conductors 5 and 6 are available for electrically conductively connecting to the contact elements 7 and 8.

Subsequently, the groove 11 is cut into the casing 4, for example, by means of a milling cutter, into which the pre-tensioned O-ring 10 is placed. For this purpose, the O-ring 10 can be pushed in a somewhat expanded state, preferably from the end of the line 1 with the exposed strands 2 and 3, onto the line 1. The O-ring engages, in the assembled position with a correspondingly dimensioned pre-tension, tightly and securely against the lateral walls of the groove 11, wherein the O-ring is no longer in the expanded state. However, the groove 11 can also be cut into the casing 4 already prior to the removal of the casing 4 for exposing the strands 2 and 3, or prior to the removal of the insulation. This is also true for positioning the O-ring 10. The work steps of removing the casing 4 and removing the insulation from the strands 2 and 3 are then subsequently carried out.

After carrying out the described work steps—no matter in what sequence—the contact elements 7 and 8 are electrically conductively connected to the conductors 5 and 6, for example, as already mentioned, advantageously by crimping. The end of the line 1 prepared in this manner is subsequently placed into an injection molding tool in which the protective body 9 is injection molded. The material of the protective body 9 is tightly and securely connected to the material of the O-ring 10, so that at the location of the O-ring, a hermetically tight barrier is obtained against any moisture which spreads along the surface of the casing 4 of the line 1.

The invention claimed is:

1. Method for sealing an electrical coupling piece against moisture in which electrical conductors of a line, which include a casing of insulating material jointly surrounding the conductors, are connected to electrical contact elements of the coupling piece, and where a protective body of insulating material is injection molded around the connecting point between conductors and contact elements and with the inclusion of the sealing element, said method comprising the steps of:

at an end of the line, intended for connection to the coupling piece, at least one annular groove extending in the circumferential direction is cut into the casing of the line; and prior to injection molding the protective body, an O-ring sealing element is placed in the groove which rests securely with a corresponding pretension against the lateral borders of the groove, and which is of a material which connects tightly and in a moisture proof manner to the insulating material of the finally produced protective body, wherein the O-ring is pushed in an expanded pretensioned state onto the line and is placed in the groove after the expanded state of the O-ring has ended.

2. Arrangement with an electrical coupling piece and an electrical line on which the coupling piece is mounted so as to be sealed against moisture, said arrangement comprising:

a line which includes electrical conductors and a casing of insulating material, a coupling piece with electrical contact elements which are electrically conductively connected to the conductors of the line, a ring shaped sealing element placed on the casing of the line, a protective body of insulating material produced by injection molding, where the protective body is injection molded around the connecting point between conductors and contact elements and with the inclusion of the sealing element, so that the protective body extends beyond the contact elements on the one hand, and the line on the other hand, wherein the coupling piece is manufactured using the method according to claim 1, and wherein, in the area covered by the protective body, the ring shaped sealing element, formed as an O-ring sealing element is pushed in an expanded pretensioned state onto the line and is then placed in a groove cut into the casing of the line after the expanded state of the O-ring has ended, where the O-ring rests securely against the lateral borders of the groove and which is of a material which is connected tightly and in a moisture tight manner to the insulating material of the protective body.

* * * * *